United States Patent [19]

Kondo et al.

[11] Patent Number: 4,533,359

[45] Date of Patent: Aug. 6, 1985

[54] PROCESS FOR MODIFYING ANIMAL FIBERS

[75] Inventors: Takashi Kondo, Kyoto; Chikaaki Sakai; Tadashi Karakawa, both of Haguri, all of Japan

[73] Assignee: Kurashiki Boseki Kabushiki Kaisha, Japan

[21] Appl. No.: 440,251

[22] Filed: Nov. 5, 1982

[30] Foreign Application Priority Data

Feb. 12, 1982 [JP] Japan ..... 57-21460

[51] Int. Cl.[3] ..... D06M 3/08; D06M 3/10

[52] U.S. Cl. ..... 8/128 R; 435/263

[58] Field of Search ..... 8/128 R; 435/263

[56] References Cited

U.S. PATENT DOCUMENTS 2,373,974 4/1945 Phillips et al. ..... 435/263

3,628,909 12/1971 Goldberg et al. ..... 8/128 R

FOREIGN PATENT DOCUMENTS 48-38360 11/1973 Japan ..... 8/128 R

OTHER PUBLICATIONS

Sookne, A., Textile Research Jour., Aug. 1957, pp. 652–661.

Williams, V. A., Textile Research Jour., Dec. 1962, pp. 977–985.

Horio et al., Bulletin of the Institute for Chemical Research, vol. 40, Nos. 5–6, pp. 351 to 363, Kyoto University, 1962.

*Primary Examiner*—Maria Parrish Tungol

*Attorney, Agent, or Firm*—Berman, Aisenberg & Platt

[57] ABSTRACT

The present invention relates to the production of descaled animal fiber. The scale is effectively removed by oxidation of a surface of the animal fiber with an oxidizing reagent, following by treatment with a proteolytic enzyme in the presence of salt. The resulting animal fiber has excellent shrink-proof properties.

17 Claims, 2 Drawing Figures

PROCESS FOR MODIFYING ANIMAL FIBERS

BACKGROUND

The present invention relates to a process for producing shrink-proof animal fibers.

Animal fibers are covered with surface scales, which cause their felting during laundering. In order to prevent them from felting, many methods for removing the scales have been proposed, but none of them are adequate. For example, a method for removing scales by oxidizing the surface of wool with chlorine has been proposed. In such a method the oxidation must be stopped before complete removal of the scales in order to prevent the chlorine from damaging the wool itself. Japanese Patent Publication (KOKAI) No. 36342/80 discloses oxidation of wool in a highly concentrated salt solution, in which the oxidation is so efficiently effected that the scales are completely removed. However, control of the oxidation for this method is very difficult; moreover, the oxidizing reagent must be completely reduced to avoid undue yellowing of the wool fibers.

SUMMARY OF THE INVENTION

The present invention relates to a method of uniform elimination of scales without any material damage to the animal fibers themselves. Animal fibers modified according to the present invention are completely shrink-proof, have a smooth surface and have luster as well as a soft hand. Therefore, when the present invention is applied to animal fibers which have smooth scales and low feltability, such as mohair, surface luster and softness of the fibers are improved.

The present invention provides a process for producing descaled animal fibers; it comprises first oxidizing the surface of the animal and subsequently treating the oxidized fibers with a proteolytic enzyme in the presence of salt.

The animal fibers to which the present method is applicable are, typically, wool, but other animal fibers, such as vicuna, mohair, Angora, rabbit hair and Cashmere, are also exemplary.

DETAILS

Figure 1:
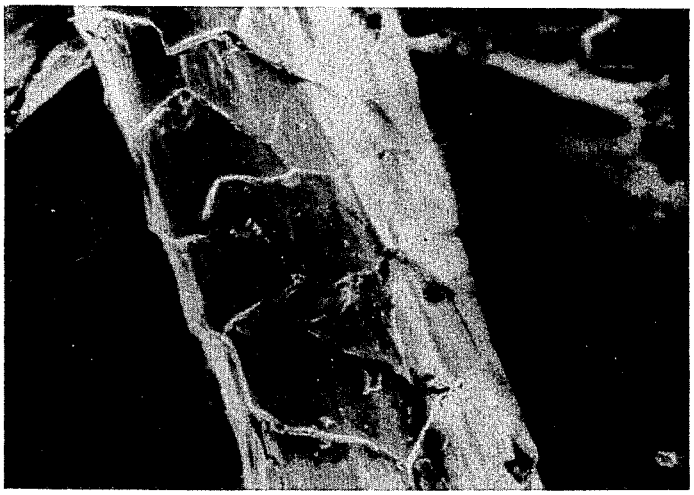
FIG. 1 and FIG. 2 are electron micrographs of non-treated wool fiber and of wool fiber treated according to the invention, respectively.

According to the present invention, the animal fibers are first oxidized. This oxidation is limited to the outside of the fibers. A main object of the oxidation is to swell the scale and to make it readily receptive to a subsequent enzyme reaction by breaking down its disulfide cross-linkage. That cross-linkage is difficult for enzyme, per se, to decompose.

It is desirable for the oxidation to have no affect on the inside of animal fibers and to be localized on their surface. In addition, the oxidation should be properly controlled according to the nature or variety of the animal fibers and so on. Ordinarily, the extent of the oxidation is controlled by the amount of oxidizing reagent used. For wool, the oxidizing reagent must be used in an amount of from 1 to 10 percent by weight of wool fibers, preferably of from about 3 to 5 percent by weight in a batch system. In an ordinary batch oxidation treatment, the fibers are treated for from 10 to 30 minutes at room temperature and subsequently for from 5 to 60 minutes, preferably from 10 to 20 minutes, at 30° to 40° C. In a continuous process, the fibers to be treated are dipped into a solution of an oxidizing reagent (from about 1 to 10 percent, preferably from about 3 to 5 percent by weight), for from 3 to 20 seconds, followed by squeezing about 100 percent of the liquid therefrom and finally holding them for from about 1 to 5 minutes. These conditions are standard; the oxidation is by no means restricted to such conditions.

As oxidizing agents, hypochlorites, chlorites, dichloroisocyanaurates, permanganates, hydrogen peroxide, monopersulfuric acid and salts thereof are illustrative. Preferred oxidizing agents are dichloroisocyanurates and permanganates.

The oxidation of the present invention is preferably carried out in an aqueous solution of an inorganic salt, such as sodium chloride, Glauber's salt and ammonium sulfate, particularly in a saturated or nearly saturated aqueous solution of one or more of these salts, according to the kind of oxidizing agent, and more preferably at pH 4 or so. By incorporating the oxidizing agent into such a solution, oxidation is successfully effected. Furthermore, oxidation is optionally conducted by initial dipping of the animal fibers into a saturated or nearly saturated aqueous acidic solution of previously-noted inorganic salt and subsequent transferring of the fibers into a saturated or nearly saturated aqueous inorganic-salt solution containing oxidizing agent. According to these processes absorption of the solution into the animal fibers is effected more uniformly, thus making possible localization of the oxidation within the scales. Further, damage to fiber cortex can be controlled by these processes. The pretreatments are ordinarily carried out at from 10° to 30° C., preferably at from 20° to 25° C., for about 10 minutes, the process is not so restricted. Permeability of the oxidizing agent into the animal fibers may be improved by adding a suitable surfactant to the treatment medium, if necessary.

After the oxidized animal fibers are sufficiently rinsed with water, it is important that oxidizing reagent remaining in the inside of the fibers be eliminated. This is accomplished with a reducing reagent. Suitable reducing reagents are, e.g., sodium metabisulfite, sodium bisulfite, sodium sulfite and the like. The amount of reducing reagent employed is optionally from about 3 to 6 percent by weight of the animal fibers. After the reducing treatment, the resulting fibers must be sufficiently rinsed again.

Thus-treated animal fibers are subsequently subjected to proteolytic enzyme treatment. A preferred enzyme is one having a low substrate specificity, such as bacterial proteolytic enzyme, for example Bacillus subtilis protease, Actinomycetes protease and the like. Using an enzyme of low substrate specificity, the scale part of the animal fibers is uniformly decomposed. Papain, trypsin and the like are also conveniently used for this purpose, but these enzymes are liable to damage the fibers partially and, therefore, delicate care is necessary in the enzyme treatment with such an enzyme; also, longer enzyme-treatment times are required.

The treatment with proteolytic enzyme is preferably carried out in a saturated or nearly saturated aqueous solution of an inorganic salt, such as sodium chloride, Glauber's salt, ammonium sulfate and the like, which controls excess decomposition of animal fibers attributed to the enzyme. Unnecessary damage to the fibers themselves is thus avoided.

Conditions of the enzyme treatment are suitable selected according to the variety of enzyme used. In general, animal fibers are treated for from 1 to 2 hours at about pH 6.0 with from 2.0 to 4.0 percent by weight, based on the weight of the fibers, of enzyme at a temperature at which the enzyme is most activated. The enzyme treatment is finished when the scales of the animal fibers are completely removed, which is readily ascertained by microscopic observation.

The enzyme-treated animal fibers are rinsed with an aqueous solution of a surfactant after removing them from the enzyme treating solution. The surfactant is preferably a nonionic surface-active agent. Subsequently, the treated fibers are dipped into hot water (about 80° C.) to deactivate residual enzyme and dried.

Wool obtained by such treatment has a beautiful mohair-like luster and softness and is completely shrink proof. Restriction of usable dyestuff and decrease in color fastness (particularly at deep color dyeing, as observed in conventional resin-treated shrink-proofed wool) are not observed. Further, the treatment of the present invention is easily controlled, and the treated wool hardly yellows at all.

EXAMPLE 1

Australian Merino top having a diameter of 22μ is dipped into an aqueous solution containing 2 moles/liter of ammonium sulfate and 0.01 percent by weight of penetrant (Emal 20C: sodium alkyl sulfate, available from KAO SOAP CO., LTD.) for 10 minutes at 20° C. Into the solution, 2.5 percent by weight of potassium permanganate (based on the weight of the top) is added to react with the top for 10 minutes. The temperature is increased to 40° C., and the reaction is continued until the permanganate ion color (deep violet) disappears, after which the dipped top is adequately rinsed with water.

The rinsed top is dipped into aqueous solution containing 6 percent by weight of acetic acid and 6 percent by weight of sodium bisulfite (based on the weight of the top to be reduced) at about 50° C. for about half an hour.

The dipped top is adequately rinsed with water and then dipped into an aqueous solution (pH 6) containing 2 moles/liter of ammonium sulfate and 2 percent by weight of Bacillus subtilis protease (celliase conc. available from NAGASE SEIKAGAKU KK.) at a liquor ratio of 1/10 for enzyme treatment at 50° C. for about one hour.

After removing enzyme solution and sufficiently washing the top with an aqueous solution of 0.1 percent by weight of nonionic surface active agent, the top is rinsed again with water, and the rinsed wool is dipped into hot water (about 80° C.) for 20 minutes so that the activity of the enzyme is lost. The resultant is dried at from 80° to 90° C. to obtain a descaled wool top.

Figure 2:
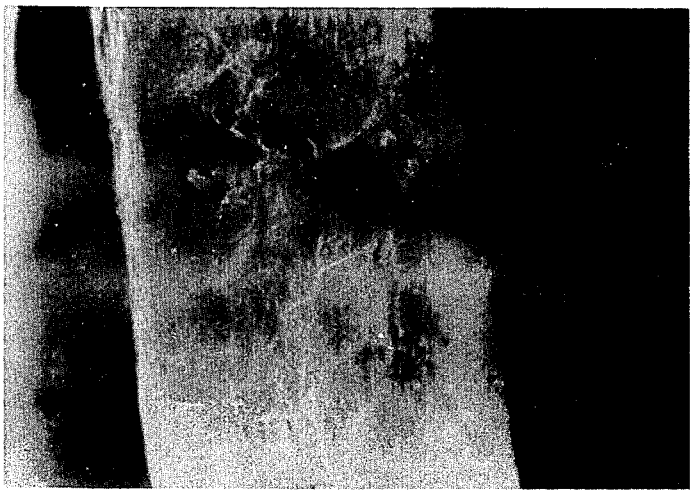

The obtained top has an average diameter of 20.5μ, excellent luster and a soft and smooth hand. Electronmicrographs (×1000) of non-treated wool and of treated wool of the present invention are FIGS. 1 and 2, respectively. FIG. 2 shows that scales are completely removed from the surface of the wool.

A spun yarn (Jersey yarn: Metric Count 40, and Number of Twist 510/m), using the resulting descaled top, is knitted; the shrink-proofing property and antipilling property thereof are determined and compared with those of yarn from non-treated top. The results are shown in Table 1.

In the determinations, the shrinking percentage is measured according to TM-185 of IWS (washing time: 3 hours), and the antipilling property is measured according to JIS L-1076: C.

TABLE 1

| | yarn made of top treated according to the present invention | yarn made of non-treated top |
|---|---|---|
| percent shrinkage | −1.0 | +40.0 |
| artipilling | 4–5 | 1–2 |

EXAMPLE 2

Australian cross-bred wool top having a diameter of 30μ is washed in a solution containing 0.05 percent by weight of nonionic surface active agent (Scourol 900: polyethylene glycol ether of alkyl phenol, available from KAO SOAP CO., LTD) at a liquor ratio of 1/10 at 40° C. for 10 minutes. After draining, it is rinsed.

The rinsed top is dripped into an aqueous solution (controlled at pH 4.5) containing 0.01 percent by weight of penetrant (Tergitol TWN: polyethylene glycol ether of higher alcohol, available from Union Carbide Chem. Co.) and 20 percent by weight of Glauber's salts (based on the weight of the wool) at room temperature for 10 minutes. Subsequently, 2.5 percent by weight of sodium dichloroisocyanurate (Hylight 60G: NISSAN CHEMICAL INDUSTRIES, LTD.), as pure material, are added to the solution, and the top is treated therein for about 15 minutes. 2 g/liter of sodium bisulfite are added to the solution and the top is treated therein at from 35° to 40° C. for 20 minutes, followed by draining and adequate rinsing.

The resultant top is subjected to enzyme treatment for one hour in an aqueous solution containing 2 moles/liter of ammonium sulfate and 2 weight percent of Bacillus subtilis protease (celliase conc.: available from NAGASE SEIKAGAKU K.K.) and controlled at pH 6 and at 50° C.

After removing the enzyme solution, the top is adequately washed with an aqueous solution of 0.05 percent by weight of nonionic surface active agent (Scourol 900) and then subjected to an enzyme inactivation treatment at 80° C. for 20 minutes to yield a descaled wool top after drying at from 80° to 90° C.

The obtained wool fibers have a diameter of 28.5μ, excellent luster and a smooth hand.

A spun yarn (hand knitting yarn, Metric Count: 3/7.5; Twist Number: original twist 150/m and final twist 80/m) is made of the resulting wool top; the shrink-proofing property and the antipilling property are determined and compared with those of yarn of non-treated wool top. The results are shown in Table 2. Percent shrinkage is measured according to TM-192 of IWS (washing time: 60 minutes), and antipilling is measured according to JIS-L-1076: D.

TABLE 2

| | Yarn made of wool top according to the present invention | Yarn made of non-treated wool top |
|---|---|---|
| percent shrinkage | +1.4% | +60.5% |
| antipilling | 4–5 | 2 |

Amounts of fluffies and pills after the determination of JIS-L-1076-D are shown in Table 3.

TABLE 3

| | falling-off pills | falling-off fluffies | pills attached to test piece | fluffies attached to test piece | total pills | total fluffies |
|---|---|---|---|---|---|---|
| Yarn made of non-treated top | 36.1 | 23.7 | 33.4 | 26.8 | 69.5 | 50.5 |
| Yarn made of top treated according to the present invention | 24.9 | 32.3 | 0.4 | 13.5 | 25.4 | 45.8 |

The invention and its advantages are readily understood from the preceding description. Various changes may be made in the process and resulting products without departing from the spirit and scope of the invention or sacrificing its material advantages, the hereinbefore-described processes and products being merely illustrative of preferred embodiments of the invention.

What is claimed is:

1. A process for descaling animal fiber which comprises surface-oxidizing the animal fiber with an oxidizing agent and subsequently treating said fiber with a proteolytic enzyme in a saturated or nearly saturated aqueous inorganic-salt solution.

2. A process of claim 1 in which the animal fiber is wool.

3. A process of claim 1 which comprises dipping the animal fiber into a saturated or nearly saturated aqueous inorganic-salt solution prior to surface-oxidizing said fiber.

4. A process of claim 1 in which surface-oxidizing is effected with a permanganate.

5. A process of claim 1 in which the oxidation is effected in an aqueous salt-containing solution.

6. A process of claim 5 which comprises dipping the animal fiber into a saturated or nearly saturated aqueous inorganic-salt solution prior to surface-oxidizing said fiber.

7. A process of claim 5 in which surface-oxidizing is effected with a permanganate.

8. A process of claim 5 in which the salt-containing solution is saturated or nearly saturated with inorganic salt.

9. A process of claim 1 in which the oxidizing agent is a member selected from the group consisting of a hypochlorite, a chlorite, a dichloroisocyanurate, a permanganate, hydrogen peroxide, monopersulfuric acid and a monopersulfate.

10. A process according to claim 9 in which the oxidizing agent is hydrogen peroxide.

11. A process according to claim 9 in which the oxidizing agent is a dichloroisocyanurate.

12. A process of claim 9 in which the oxidizing agent is monopersulfuric acid.

13. A process of claim 9 in which the oxidizing agent is a monopersulfate.

14. A process of claim 1 in which the proteolytic enzyme is a bacterial proteolytic enzyme which has low substrate specificity.

15. A process of claim 14 in which the bacterial proteolytic enzyme is a protease of Bacillus subtilis or of Actinomycetes.

16. A process of claim 15 in which the bacterial proteolytic enzyme is a protease of Bacillus subtilis.

17. A process according to claim 15 in which the bacterial proteolytic enzyme is a protease of Actinomycetes.

* * * * *